US006925686B2

(12) United States Patent
Heathcock et al.

(10) Patent No.: US 6,925,686 B2
(45) Date of Patent: Aug. 9, 2005

(54) TWIST-LOCK HANDLE ASSEMBLY

(75) Inventors: John A. Heathcock, Racine, WI (US); Peter M. Neumann, Racine, WI (US); Michael E. Short, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 285 days.

(21) Appl. No.: 10/178,634

(22) Filed: Jun. 20, 2002

(65) Prior Publication Data

US 2003/0233718 A1 Dec. 25, 2003

(51) Int. Cl.[7] ..... B25G 3/00; B25G 1/04

(52) U.S. Cl. ..... 16/429; 16/427; 16/436; 15/144.4; 15/145

(58) Field of Search ..... 16/429, 427, 422, 16/405, 436; 81/177.1, 177.2, 489; 15/143.1, 144.1, 1, 144.4, 145, 159.1, 235.8, 236.3; 294/57, 19.1–19.3; 403/107, 109.1, 109.4, 377

(56) References Cited

U.S. PATENT DOCUMENTS

| | | | | |
|---|---|---|---|---|
| 303,474 A | | 8/1884 | Webb | |
| 305,140 A | | 9/1884 | Bradley | |
| 402,132 A | | 4/1889 | Berry | |
| 1,029,819 A | | 6/1912 | Nylander | |
| 1,033,187 A | | 7/1912 | Metzger | |
| 1,420,639 A | | 6/1922 | Sturgis | |
| 1,932,099 A | | 10/1933 | Cababa | |
| 2,076,918 A | | 4/1937 | Robison | |
| 2,601,088 A | | 6/1952 | Burgess | |
| 2,660,457 A | * | 11/1953 | Mallon | 285/7 |
| 2,712,950 A | | 7/1955 | Siebert | 285/161 |
| 2,719,061 A | | 9/1955 | Beatty | |
| 2,820,655 A | | 1/1958 | Hileman | |
| 3,153,252 A | * | 10/1964 | Ricciardi | 15/144.4 |
| 3,407,424 A | * | 10/1968 | Lanzarone et al. | 15/145 |
| 3,423,781 A | | 1/1969 | Henson | |
| 3,866,257 A | * | 2/1975 | Cansdale, Sr. | 15/230.11 |
| 3,957,266 A | | 5/1976 | Rice | |
| 4,070,932 A | * | 1/1978 | Jeannotte | 81/177.2 |
| 4,247,216 A | * | 1/1981 | Pansini | 403/109.3 |
| 4,518,162 A | | 5/1985 | Oates | |
| 4,758,023 A | | 7/1988 | Vermillion | 285/7 |
| 4,848,956 A | | 7/1989 | Pettman | |
| 4,911,573 A | | 3/1990 | Pietro | |
| 5,094,464 A | | 3/1992 | Musacchia, Sr. | |
| 5,661,868 A | * | 9/1997 | Panagakos et al. | 15/184 |
| 5,920,944 A | * | 7/1999 | Biggs et al. | 15/144.4 |
| 5,943,727 A | | 8/1999 | Freer | |

FOREIGN PATENT DOCUMENTS

| | | | | |
|---|---|---|---|---|
| DE | 333391 | | 8/1913 | |
| FR | 2685623 A3 | * | 7/1993 | A47L/13/16 |
| GB | 10945 | | 6/1911 | |
| GB | 16504 | | 7/1912 | |
| GB | 338856 | | 11/1930 | |
| GB | 1429924 | | 3/1976 | |
| GB | 2249947 A | * | 5/1992 | A47L/13/42 |
| IT | 683025 | | 8/1961 | |

* cited by examiner

*Primary Examiner*—Chuck Mah

(57) ABSTRACT

A twist-lock handle assembly includes sections that are interconnected by first telescoping them together, followed by relative rotational movement to interlock two pair of axially spaced apart tabs and recesses. The assembly can have a grip section, at least one pole section, and one accessory attachment section for connecting to a mop head. The components are rigidly and essentially permanently connected by sliding them together and twisting, but can be compactly shipped.

11 Claims, 6 Drawing Sheets

TWIST-LOCK HANDLE ASSEMBLY

CROSS-REFERENCE TO RELATED APPLICATIONS

Not applicable.

STATEMENT OF FEDERALLY SPONSORED RESEARCH OR DEVELOPMENT

Not applicable.

BACKGROUND OF THE INVENTION

This invention relates to handles, and in particular to handles for mops, brooms and other items which are formed of multiple interconnectable sections.

Mops, brooms, paint roller handles, dusters, and similar devices, often have long handles so that a person can stand upright while reaching the floor with the device, and/or such that a person will not need a ladder to apply the device on a ceiling or high along a wall. The length of the handle typically requires such products to be shipped in specially sized packages, and stored and displayed for sale in a manner that takes up a relatively large amount of space.

Also, when a consumer purchases such a highly elongated device, the device may not fit easily into a standard grocery cart, and may be difficult to fit into a trunk of certain compact cars. Consumers may therefore need to hand carry the device to the store checkout, and then to a vehicle. Consumers may then need to transport the device in the passenger compartment of the car, with the result that needed passenger space is taken up.

Collapsible handles have been devised to minimize or avoid these problems. For example, telescoping handles, with multiple concentric cylindrical sections, have been developed (particularly for use when painting, and often for use in devices such as golf ball retrievers). Alternatively, some handle designs have folded sections which are hinged together. See e.g. U.S. Pat. No. 5,943,727.

Such constructions typically have rather unstable joints that can loosen (and possibly separate), particularly when rotational force is applied to the handle. These constructions also often tend to flex more at the joints when stressed such that the handle feels segmented.

Attempts have been made to overcome this problem. For example, U.S. Pat. No. 4,911,573 discloses the use of a bayonet connection for joining sections of a handle. Each section has male and female ends that mate with the ends of adjacent sections. The male ends have an L-shaped groove and a spring element spaced apart along the circumference of the male end.

The female end defines a cylindrical opening with a transverse protrusion that rides in the L-shaped groove as the male is inserted and twisted into the opening. The protrusion is held tightly in the groove by virtue of the groove having a decreasing depth. The female end also has a hole in which the spring element of the male end snaps to lock the adjacent sections together. Although the disclosed structure provides a rigid connection, it is rather complex to manufacture since it requires the spring element.

Accordingly, there exists a need in the art for an improved multi-component handle, particularly one that can be shipped, stored, and sold in multiple segments, and then easily and essentially permanently assembled by a consumer.

SUMMARY OF THE INVENTION

The invention provides a multi-segment handle in which the parts can be quickly snapped together to be essentially rigid along its length as if it was a monolithic structure. In one aspect the invention provides a handle assembly having at least two elongated sections, one elongated section having a female end defining an internal cavity and the other elongated section having a male end sized to fit within the cavity.

One of the ends has a groove extending axially from a terminal edge to a first recess. The other of the ends has a first radial projection sized to fit within the groove. Also, one of the ends has a second recess. There is also a second radial projection on the other of the ends.

When the male end has been telescoped into the female end by relative axial movement there between, the female end male ends can be locked together by causing a relative rotation there between. This will cause the first radial projection to extend into the first recess and the second radial projection to extend into the second recess. Importantly, the first and second recesses will be axially spaced from each other when the male and female ends have been locked together In preferred forms the first and second radial projections are on the male end, the first and second recesses are along the cavity of the female end, and the groove is along the cavity of the female end and circumferentially spaced from both of the recesses. Also, the first and second radial projections are essentially circumferentially aligned.

To insure that the rotational movement can be easily achieved without compromising locking strength, at least one of the first and second radial projections is ramped. Also, the female end includes an intermediate region extending into the cavity between the groove and the second recess radially inward more than the groove. Further, the intermediate region ramps radially outward towards the groove.

In still other preferred forms, the first recess is a through opening and the second recess is not a through opening. For example, the first recess can be a D-shaped through opening with the first radial projection being D-shaped. In such a case, the first radial projection can be ramped in a circumferential direction extending from the groove to the first recess.

The device is most useful as providing a handle to be used with a cleaning accessory linked to one of the elongated sections.

In another form the invention provides a handle assembly having an elongated grip section with an outer surface suitable to act as a handle and a lower connector end. There is also at least one elongated pole section having an upper connector end and a lower connector end, and an elongated accessory attachment section having an upper connector and a lower yoke structure having multiple arms for receiving an accessory. At least one upper connector and one lower connector end are configured such that they can be snap locked together by telescoping them together followed by relative rotational movement there between to cause a pair of axially spaced tabs to engage a pair of axially spaced recesses.

It will be appreciated that both projections could be on the male member (with both recesses on the female member), or that both projections could be on the female member with both recesses being on the male member, or that each of the members could have one recess and one projection. Nevertheless, for ease of manufacture, it is preferred that the female member have the recesses.

Thus, the sections can be snap-locked together by a telescoping movement followed by a simple rotational motion. Unlike conventional bayonet connections, the connection is essentially permanent due to the dual connector feature, and the edges of the projections and recesses.

The required twisting force is minimal due to the ramped surfaces of the projections. However, the connection strongly resists relative unlocking rotation between them because of abutting flat surfaces of the projections and the recesses when the sections are interlocked. As such, it is very hard to uncouple the sections.

These and other advantages of the invention will be apparent from the detailed description and drawings.

DETAILED DESCRIPTION OF THE PREFERRED EMBODIMENTS

The invention provides a multi-segment handle that can be advantageously connected to mop heads or other devices such as paint rollers. The handle consists of several short (preferably less then one foot in length) sections that can be shipped and sold in small packages that can be displayed on conventional horizontal shelving and easily toted home by consumers.

Figure 1:
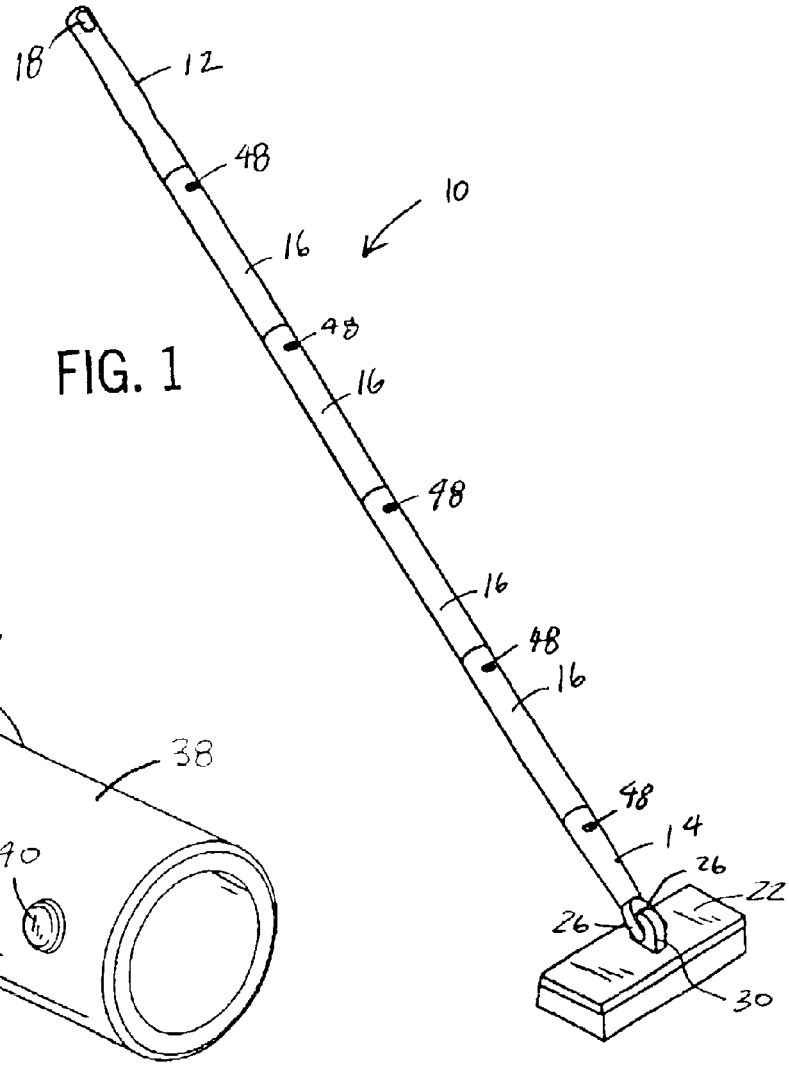
FIG. 1 is a perspective view of a floor mop provided with a multi-segment handle according to the present invention.
Figure 2:
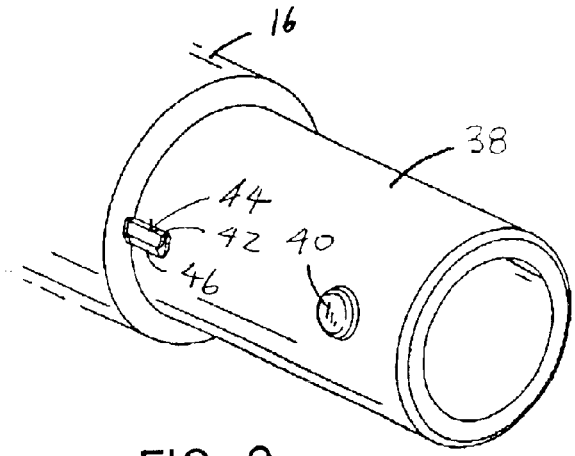
FIG. 2 is a partial perspective view of a male end of a pole section of the handle.

Referring to FIG. 1, the handle 10 has an upper grip section 12, a lower accessory section 14 and one or more (preferably four) pole sections 16. The components are preferably molded of a suitable rigid plastic, such as a nylon, preferably glass-filled nylon, however other materials could be used, for example a low cost metal.

Referring to FIGS. 4–9, the grip section 12 is preferably molded hollow to approximately 10–30 cm (4–12 inches) in length and about 2.5 cm (1 inch) in diameter. It may also have an ergonomic contour for grasping by a hand. The upper end of the grip section 12 has an opening 18 for hanging the handle 10 on a hook, nail or the like inserted either directly through the opening 18 or through a suitable strap (not shown) looped through the opening 18.

The downward end of the grip section 12 may have either a female or a male connection end 20. It is only important that the portion of the pole section 16 to be adjacent to it has the opposite type of end.

Referring next to FIGS. 1 and 14–16, at the opposite end of the handle 10 is the accessory section 14 to which can be attached various accessories 22 such as a bristled head (as in a broom or brush) or wet or dry mop heads. The accessory section 14 defines a yoke 24 at its lower end. The yoke 24 includes two arms 26 each preferably having a recess 28 (one shown) that can receive a hinge pin 29 extending through or from a side of a upstanding member 30 (see FIG. 1) of the accessory 22.

Opposite the yoke 24, the accessory section 24 defines an enlarged connection end 32. Again, the end can be either a male end, or a female end, with it merely being important that the portion of a pole section to adjoin it must have the opposite type of end.

Referring next to FIGS. 2–3 and 10–13, between the grip 12 and accessory 14 sections are one or more interconnected pole sections 16. The number of pole sections 16 will depend on the desired length of the handle 10 when assembled and the desired size of the unassembled handle with consideration for intended size of the product package. In the preferred form shown in FIG. 1, the handle 10 includes four identical pole sections 16. Together, the overall handle is of a typical length for a mop handle.

Each pole section 16 is preferably hollow with an outer diameter of one size, approximately 2.5 cm (about 1 inch), for most of its length, albeit with a narrower diameter female connection end 34. The female connection end has an internal cavity 36 (see FIG. 3) suitable to receive an opposite male connection end 38 of decreased diameter.

The male and female ends will be described herein with respect to the pole sections. However, it should be appreciated that the male end of the grip section (see FIGS. 7–9) and the female end of the accessory section (see FIGS. 15 and 16) are configured identically to the corresponding ends of the pole sections. Figures showing the ends of the grip and accessory sections will be used to aid in the description of the ends of the pole sections.

The male connection end 38 is formed with two sets or pairs of radially projecting elements, namely bosses 40 and ratchets 44. The boss and ratchet in each set are generally axially aligned and spaced apart, the boss being spaced in from the terminal end of the male end and the ratchet being axially spaced in further, at the shoulder. Each set is spaced from the other set preferably 180 degrees.

The bosses 40 are shallow circular projections projecting radially outward with tapered circumferences. As can best be seen in FIGS. 2 and 8–9, the ratchets 44 project radially outward and extend axially a short distance, approximately 5 mm (slightly less than ¼"). Each ratchet 44 has a flat side 42 and a ramped side 46 sloping downwardly away from the flat side.

Figure 3:
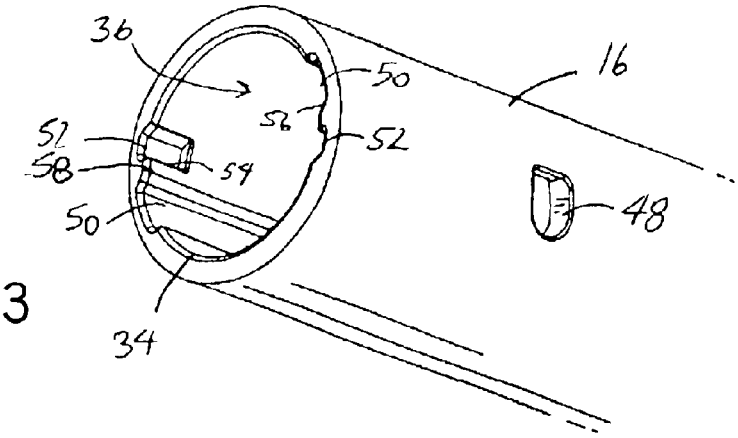
FIG. 3 is a partial perspective view of a female end of the pole section of the handle.
Figures 4, 5, 6, 7, 8, 9:
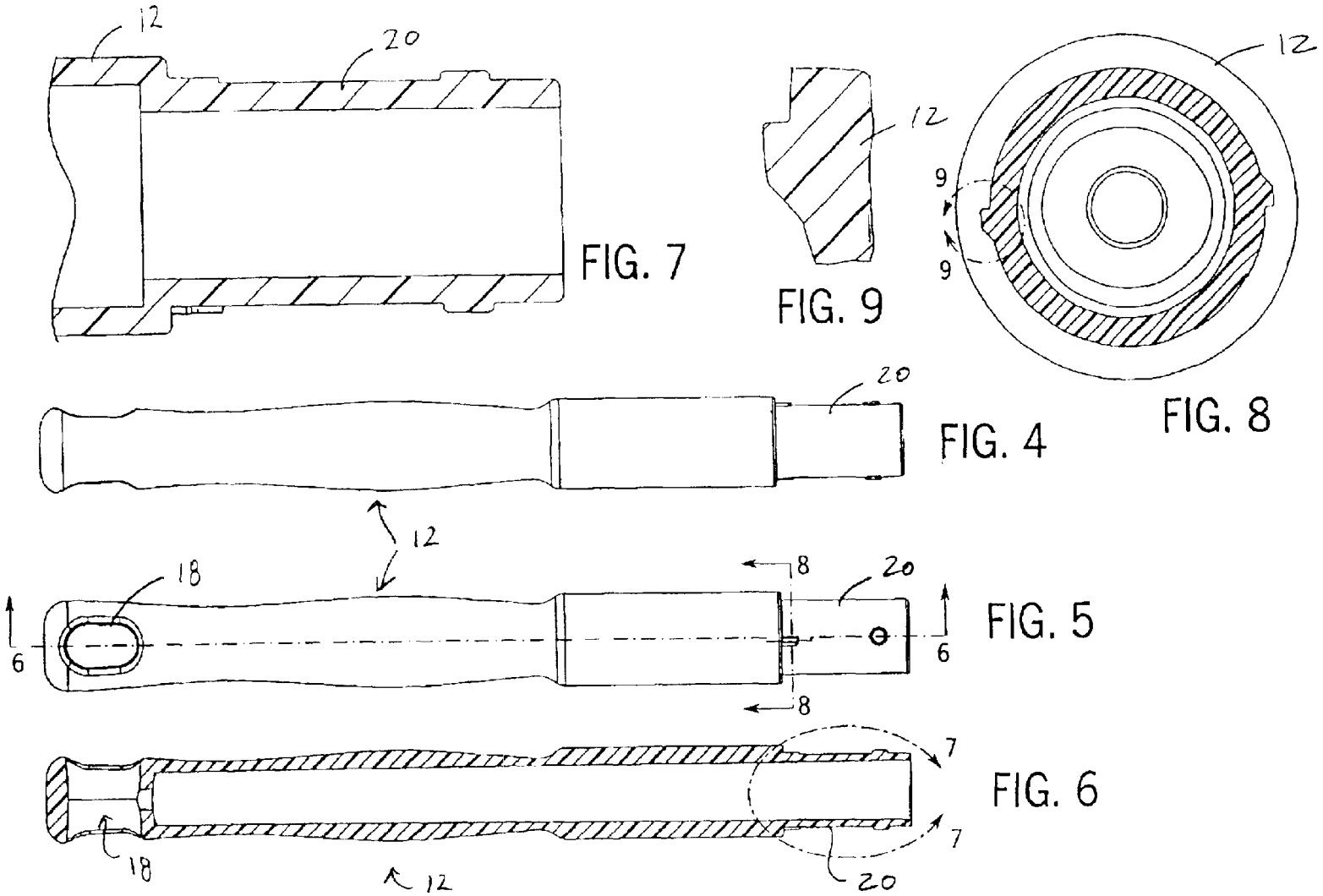
FIG. 4 is a side elevational view of a grip section.
FIG. 5 is a top elevation view of the grip section of FIG. 4.
FIG. 6 is a cross-sectional view of the grip section taken along line 6—6 of FIG. 5.
FIG. 7 is an enlarged partial cross-sectional view of a male end of the grip section focusing on portion 7—7 of FIG. 6.
FIG. 8 is a cross-sectional view taken along line 8—8 of FIG. 5.
FIG. 9 is an enlarged cross-sectional detail view of a projection of the male end focusing on portion 9—9 of FIG. 8.
Figure 10:
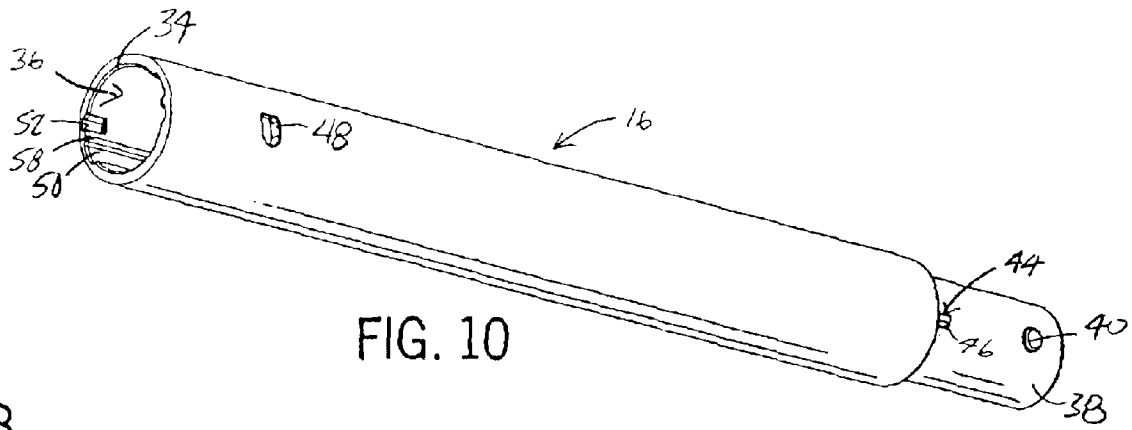
FIG. 10 is a perspective view of a pole section of the multi-segment handle of FIG. 1.
Figure 13:
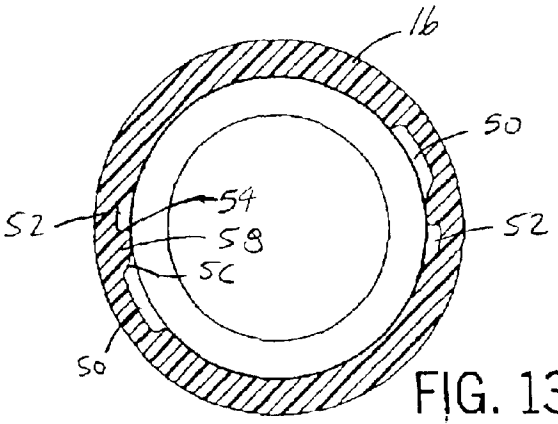
FIG. 13 is a vertical cross-sectional view taken through the female end of FIG. 12.
Figure 14:
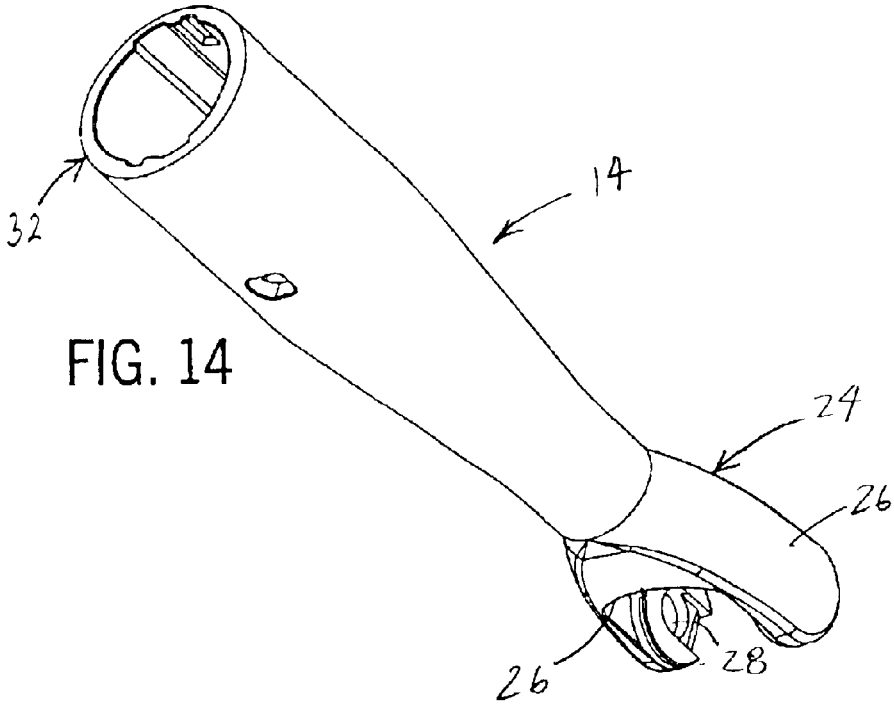
FIG. 14 is a perspective view of a yoke section of the multi-segment handle of FIG. 1.
Figure 15:
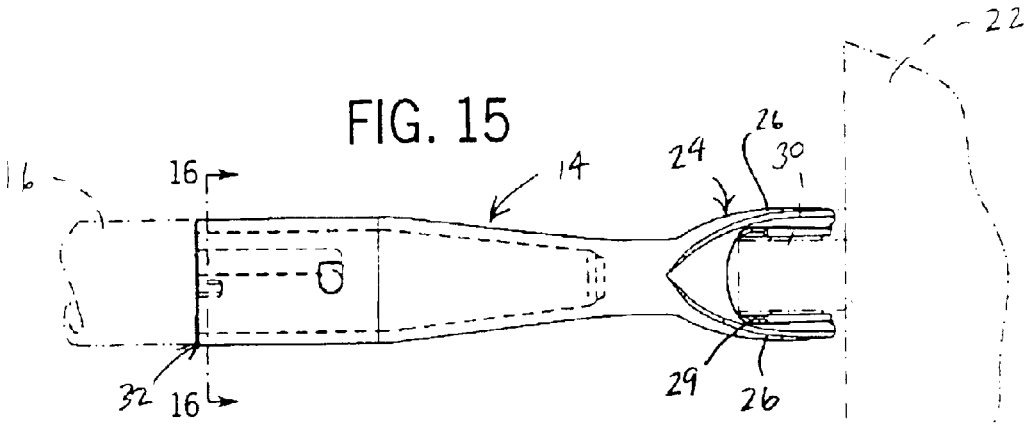
FIG. 15 is a top elevational view of the yoke section of FIG. 14.
Figure 16:
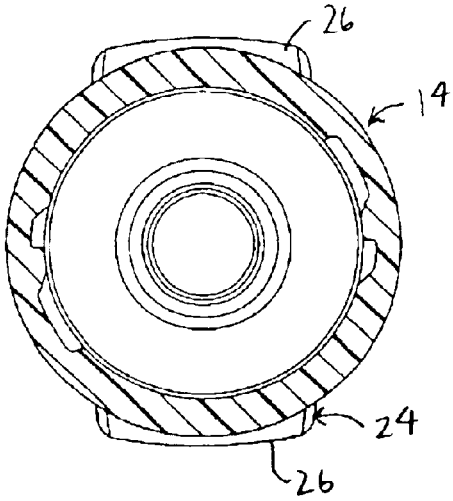
FIG. 16 is a cross-sectional view taken along line 16—16 of FIG. 15.
Figure 17:
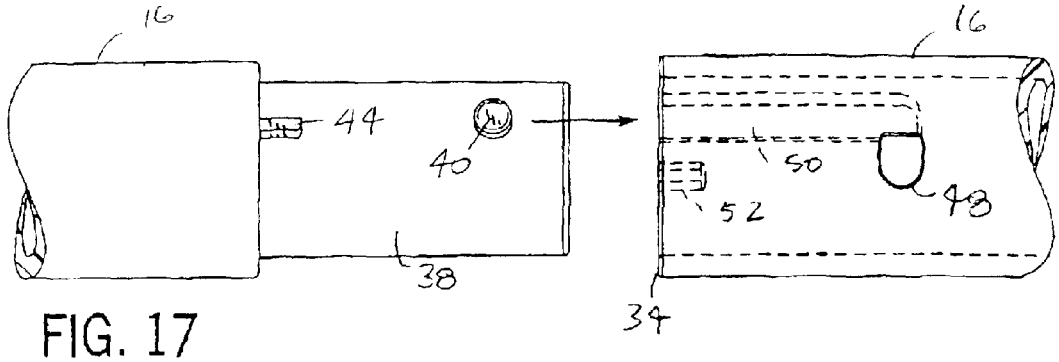
FIG. 17 shows matable male and female ends prior to being connected.

Referring to FIGS. 3, 10 and 13, the female connection end 34 includes two D-shaped openings 48 in communication with the internal cavity 36 spaced apart 180 degrees and oriented with the flat side being axial and its bottom being nearest the terminal edge of the female connection end 34. The openings thus extend in a circumferential direction to the grooves.

Figure 11:
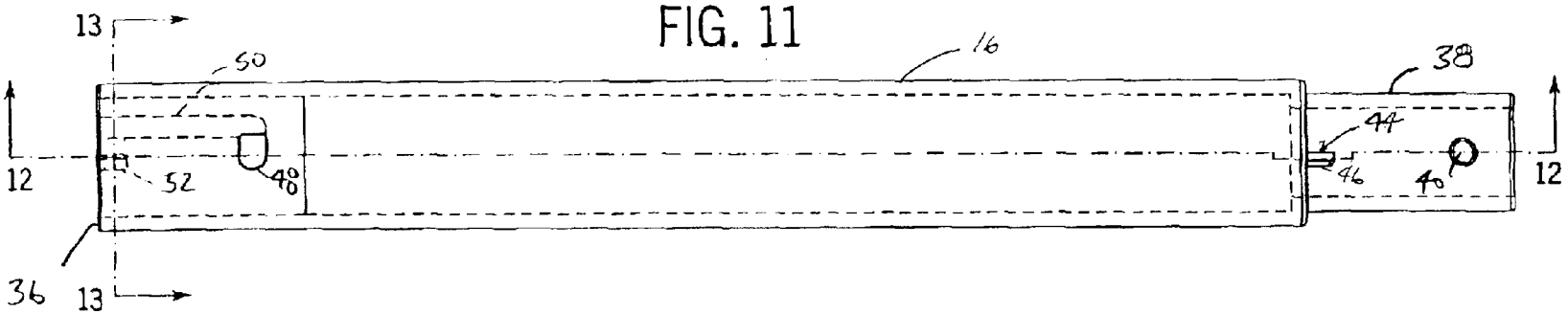
FIG. 11 is a top elevational view of the pole section of FIG. 10.
Figure 12:
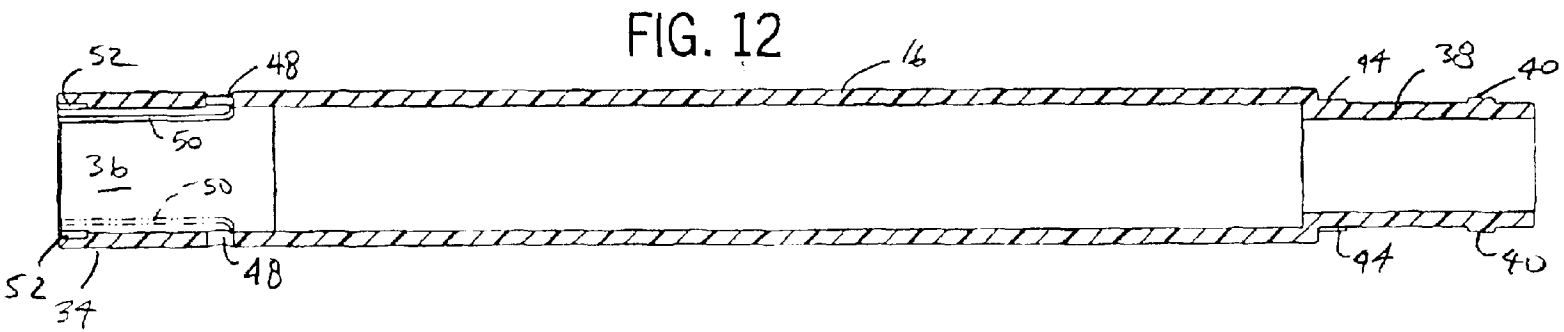
FIG. 12 is a cross-sectional view taken along line 12—12 of FIG. 11.

As shown in FIGS. 10, 11 and 13, the female connection end 34 is formed with two shallow parallel grooves 50 extending axially from the terminal edge to the openings 48, being axially offset but adjacent to the openings. The female connection end 34 is also formed with two pockets 52 generally axially aligned with the openings 48 and spaced circumferentially from the grooves 50. The pockets 52 are sized and configured to accommodate the ratchets, including a flat, radial surface 54.

Intermediate regions 58 lie between the grooves and the ratchets at the inner diameter of the female connection end and thus extend radially inward more than the pockets and the grooves. This interrupts free rotation of the male connection end in the female connection end by interfering with the ratchets. Locking rotation is eased by ramped surfaces 56 of the intermediate regions 58 that slope down toward the grooves.

The grip section 12 preferably has a male connection end 20 sized and is configured identically to the male connection ends 38 of the pole sections 16, and the accessory section 14 preferably has a female connection end 32 identical to the female connection ends 34. Accordingly, the grip section 12 interlocks with an adjacent pole section 16 by mating end 20 of the grip section 12 with the female connection end 34.

End 32 of the accessory section 14 interlocks with the male connection end 38 of an adjacent pole section 14. Two additional pole sections 16 interlock together and to the pole sections 16 mated with the grip 12 and accessory 14 sections. Preferably, the male connection ends are sized so that there is approximately 3.8 cm (1.5 inches) of overlap at the joints.

Figure 18:
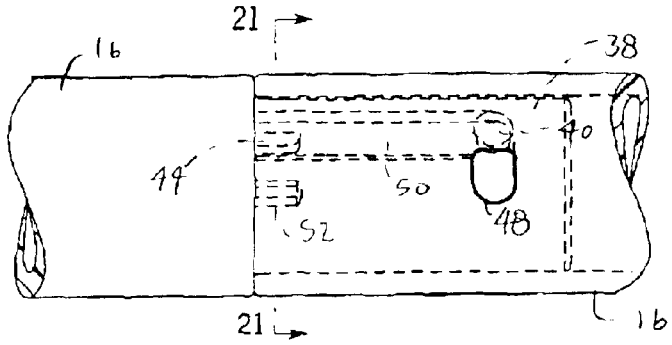
FIG. 18 shows the ends of FIG. 17 mated but prior to being locked together.
Figure 19:
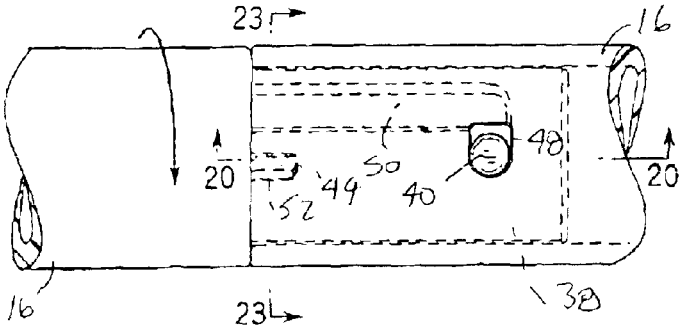
FIG. 19 shows the ends of FIG. 17 locked together after the male end has rotated clockwise such that its projections snap into the recesses of the female end.
Figure 20:
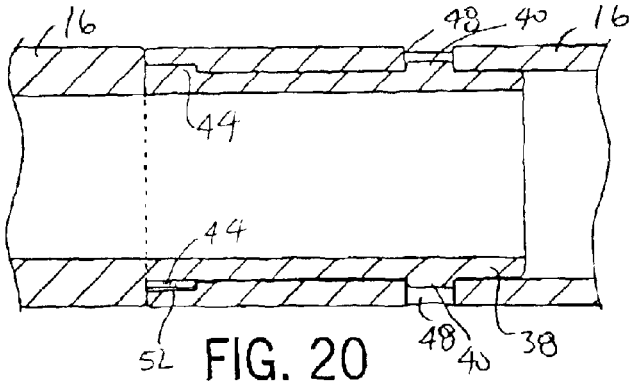
FIG. 20 is a cross-sectional view taken along line 20—20 of FIG. 19.
Figure 21:
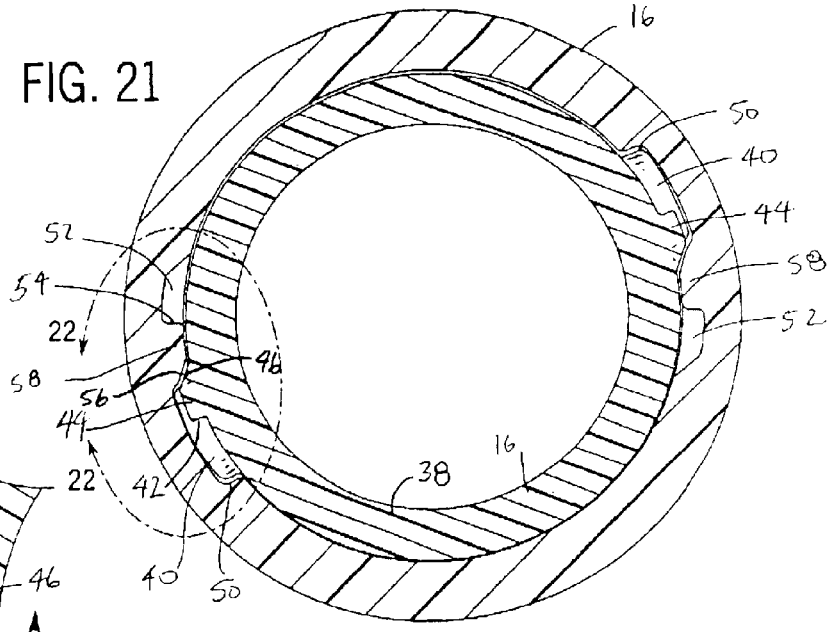
FIG. 21 is a cross-sectional view taken along line 21—21 of FIG. 18.
Figure 22:
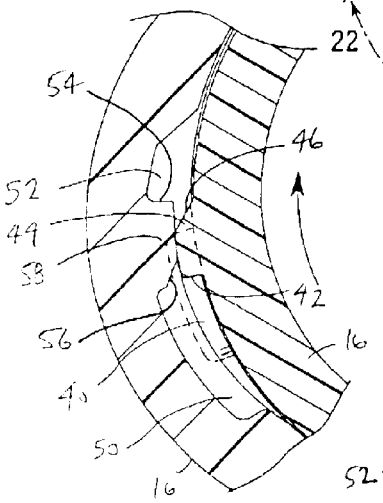
FIG. 22 is an enlarged partial cross-sectional view taken along arc 22—22 of FIG. 23.
Figure 23:
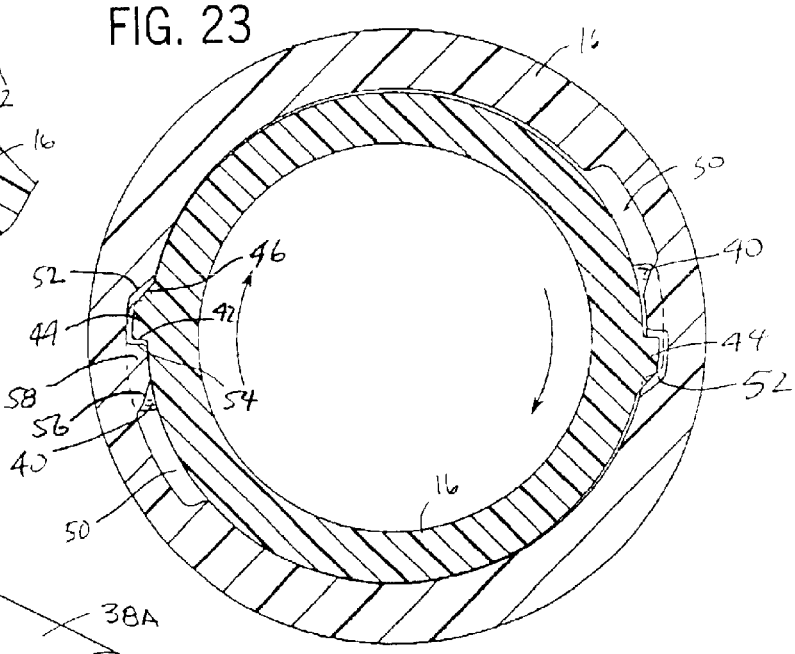
FIG. 23 is a cross-sectional view taken along line 23—23 of FIG. 19.

As shown in FIGS. 17–23, adjacent sections are mated by inserting a male end into a female end. The bosses 40 and the ratchets 44 are aligned with the axial grooves 50 and the adjacent sections are brought together until the bosses 40 reach the ends of the grooves, as shown in FIGS. 18 and 21. Rotating the male connection end with respect to the female connection, in this case in a clockwise direction, drives the bosses and the ratchets into the D-shaped openings and the pockets, respectively, as shown in FIGS. 19, 20 and 23.

As shown in FIG. 22, this rotation results in radial deflection of either or both of the male and female connection ends such that the ratchets and the bosses can pass by surfaces at the inner diameter of the female connection end radially inward further than the groove, namely the intermediate regions 58 and the small lipped area between the grooves and the D-shaped openings. The considerable force required for deflection is created by a simple twisting action by virtue of the mating ramp surfaces 46 and 56 as well as the tapered circumference of the bosses.

At this point, the built up spring force drives the bosses and the ratchets radially outward to "snap" into the D-shaped openings and the pockets, respectively (as shown in FIG. 20). Twisting and separation of the sections is resisted at the joints because of the engagement of the bosses with the walls of the D-shaped openings and more so the flat sides 42 and 54 of the respective ratchet and pocket as shown in FIG. 22. Thus, the bosses and ratchets act to properly align the mating section and also to prevent their relative rotation, particularly in the loosening direction in which the bosses would move back within the grooves.

Note also that the bosses 40 are more shallow than the thickness of the D-shaped openings 48 such that they are recessed within the openings. This, and the rigidity of the plastic, makes it difficult to compress the male ends to separate the sections. Thus, the handle is not only rigidly connected at the joints but its sections are substantially permanently connected once joined.

This structure thus provides a handle in multiple smaller sections that can be shipped and sold in a compact package while at the same time providing a handle that is rigid and seems nearly monolithic when assembled. It should be noted, however, that the sections could be made more easily separable.

Figure 24:
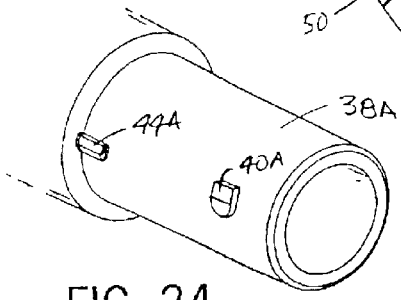
FIG. 24 is a partial perspective view similar to FIG. 2, albeit of an alternative male end.
Figure 25:
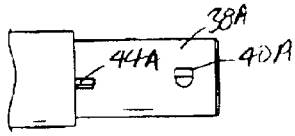
FIG. 25 is a partial top elevation view of the male end of FIG. 24.

An alternate version of a male connection end 38A for the grip 12 and pole 16 sections is shown in FIGS. 24 and 25. Like the prior embodiment, here the male connection end 38A is of a decreased diameter from the body of the section and includes two sets of bosses 40A and ratchets 44A. The ratchets are as described above, except that here the bosses are a D-shaped, like the openings 48A. In particular, each boss 40A extends at a first thickness from a flat side to an intermediate point, from which it tapers downwardly to a curved edge opposite the flat side.

Using a rigid plastic, this embodiment can provide an essentially permanent connection. The D-shape enhances the anti-rotational effect (in the loosening direction) of the bosses because of the engagement of the abutting flat surfaces of the D-shaped bosses and openings. Thus, this alternate embodiment of the male connection end could be employed to make the handle even more robust and difficult to disassemble.

Preferred embodiments of the invention have been described above in considerable detail. Other modifications and variations to the preferred embodiments will be apparent to those skilled in the art, which will be within the spirit and scope of the invention. For example, although multiple short pole sections are preferred, the assembly could comprise only one pole section (of any length) and one accessory section, without departing from the scope of the invention. Moreover, the projections could be any suitable shape, other than round and D-shaped, such as rectangular, as could the openings, which could be internal grooves or recesses that do not extend through the thickness of the section walls.

Therefore, the invention should not be limited to the described embodiments. To ascertain the full scope of the invention, reference should be made to the following claims.

Industrial Applicability

The invention provides an improved handle assembly.

We claim:

1. A handle assembly, comprising:

two elongated sections, one elongated section having a female end defining an internal cavity and the other elongated section having a male end sized to fit within the cavity;

one of the female and male ends having a groove extending axially from a terminal edge to adjacent a first recess;

the other of the female and male ends having a first radial projection sized to fit within the groove;

one of the female and male ends having a second radial projection; and the other of the female and male ends having a second recess and an intermediate region that extends radially so as to inhibit rotational movement of the second radial projection toward the second recess;

wherein when the male end has been telescoped into the female end by relative axial movement there between, the female end and male end can be locked together by causing a relative rotation there between such that the first radial projection extends into the first recess and the second radial projection passes the intermediate region and extends into the second recess; and wherein the first and second recesses are axially spaced from each other when the male and female ends have been locked together.

2. The handle assembly of claim 1, wherein the first and second radial projections are on the male end, the first and second recesses are along the cavity of the female end, and the groove is along the cavity of the female end and circumferentially spaced from both of the recesses.

3. The handle assembly of claim 2, wherein the first recess is a through opening and the second recess is not a through opening.

4. The handle assembly of claim 2, wherein the first recess is a D-shaped through opening and the first radial projection is D-shaped.

5. The handle assembly of claim 4, wherein the first radial projection is ramped in a circumferential direction extending from the groove to the first recess.

6. The handle assembly of claim 1, wherein the first and second radial projections are essentially circumferentially aligned.

7. The handle assembly of claim 1, wherein at least one of the first and second radial projections is ramped to ease engagement with respect to a recess.

8. The handle assembly of claim 1, further comprising a cleaning accessory linked to one of the elongated sections.

9. A handle assembly, comprising:

two elongated sections, one elongated section having a female end defining an internal cavity and the other elongated section having a male end sized to fit within the cavity;

one of the female and male ends having a groove extending axially from a terminal edge to adjacent a first recess;

the other of the female and male ends having a first radial projection sized to fit within the groove;

one of the female and male ends having a second recess;

the other of the female and male ends having a second radial projection;

wherein when the male end has been telescoped into the female end by relative axial movement there between, the female end and male end can be locked together by causing a relative rotation there between such that the first radial projection extends into the first recess and the second radial projection extends into the second recess;

wherein the first and second recesses are axially spaced from each other when the male and female ends have been locked together;

wherein the first and second radial projections are on the male end, the first and second recesses are along the cavity of the female end, and the groove is along the cavity of the female end and circumferentially spaced from both of the recesses; and wherein the female end includes an intermediate region extending into the cavity between the groove and the second recess radially inward more than the groove.

10. The handle assembly of claim 9, wherein the intermediate region ramps radially outward towards the groove.

11. A handle assembly, comprising:

an elongated grip section having an outer surface suitable to act as a handle and a lower connector end;

at least one elongated pole section having an upper connector end and a lower connector end; and an elongated accessory attachment section having an upper connector end and a lower yoke structure having multiple arms for receiving an accessory;

wherein at least one pair of said upper and lower connector ends is configured such that said pair of upper and lower connector ends can be snap locked together by telescoping them together followed by relative rotational movement there between to cause a pair of axially spaced tabs of one of said pair of upper and lower connector ends to engage a pair of axially spaced recesses of the other of said pair of upper and lower connector ends after at least one of said tabs engages an interfering intermediate region adjacent to an associated at least one of said recesses.

* * * * *